US008505119B2

(12) United States Patent
Nielson

(10) Patent No.: US 8,505,119 B2
(45) Date of Patent: Aug. 13, 2013

(54) GARMENT, GARMENT ACCESSORY, GARMENT BELT AND COMBINATIONS OF SAME

(76) Inventor: Kevin W. Nielson, Regina (CA)

( * ) Notice: Subject to any disclaimer, the term of this patent is extended or adjusted under 35 U.S.C. 154(b) by 771 days.

(21) Appl. No.: 12/773,476

(22) Filed: May 4, 2010

(65) Prior Publication Data

US 2011/0271422 A1 Nov. 10, 2011

(51) Int. Cl.
*A41F 9/00* (2006.01)

(52) U.S. Cl.
USPC ..... 2/235; 2/318; 2/321

(58) Field of Classification Search
USPC ..... 2/76, 106, 107, 105, 156, 219, 220, 2/221, 234, 235, 236, 237, 338, 316, 318, 2/321, 322
See application file for complete search history.

(56) References Cited

U.S. PATENT DOCUMENTS

| | | | | | |
|---|---|---|---|---|---|
| 719,560 | A * | 2/1903 | Brueckner | ..... | 2/338 |
| 756,734 | A * | 4/1904 | Tessmer | ..... | 2/312 |
| 1,197,844 | A * | 9/1916 | Muchmore | ..... | 24/1 |
| 1,319,580 | A | 10/1919 | Guild | | |
| 1,373,341 | A * | 3/1921 | McGenniss | ..... | 2/401 |
| 2,092,152 | A | 9/1937 | Daniel | | |
| 2,923,010 | A * | 2/1960 | Borzone | ..... | 2/322 |
| 4,803,740 | A | 2/1989 | Dawson | | |
| 6,473,908 | B1 | 11/2002 | Bontems | | |
| 6,859,944 | B2 * | 3/2005 | Kim | ..... | 2/237 |
| D545,029 | S | 6/2007 | Redwine | | |
| D598,180 | S | 8/2009 | Fu | | |
| 2009/0210997 | A1 * | 8/2009 | Birtch | ..... | 2/234 |

FOREIGN PATENT DOCUMENTS

| | | |
|---|---|---|
| CA | 2605022 | 10/2006 |
| DE | 10161682 | 6/2003 |

* cited by examiner

*Primary Examiner* — Danny Worrell
(74) *Attorney, Agent, or Firm* — Kyle R. Satterthwaite; Ryan W. Dupuis; Ade & Company, Inc.

(57) ABSTRACT

A garment belt features an elongated strap and a V-shaped closure member having first and second legs interconnected at joined ends thereof and diverging from one another away from the joined ends. The closure member is connected between effective ends of the strap to close the belt and form a waist loop being defined by the elongated strap, the V-shaped closure member and the connections therebetween. A garment to be worn about a wearer's waist features an open triangular notch depending into a waist portion of the garment from an upper boundary thereof on the front side of the garment. The belt, or a V-shaped accessory of similar appearance to its closure member, is wearable with the garment to provide a unique appearance, revealing an exposed triangular section of skin. The V-shaped closure or accessory may carry an ornamental jewelry piece suspended between the legs of the member.

11 Claims, 5 Drawing Sheets

FIG. 2
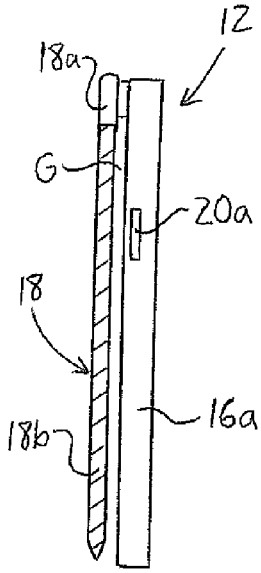
FIG. 3
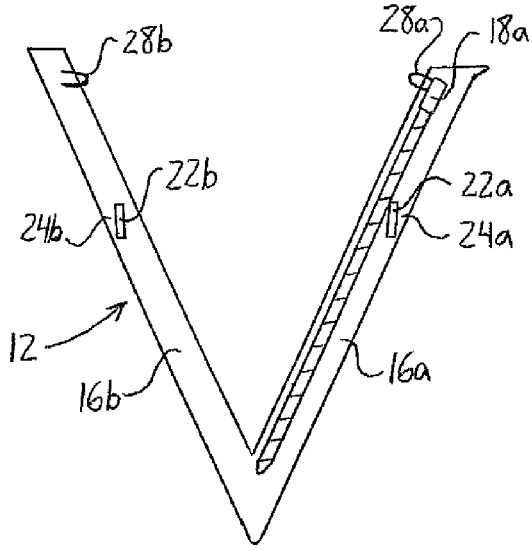
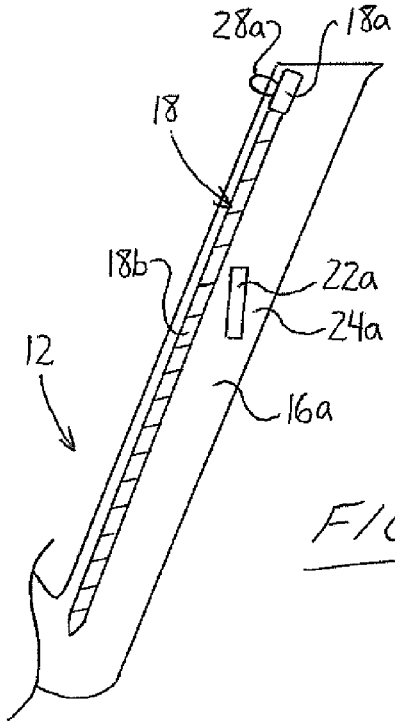
FIG. 4

FIG. 6
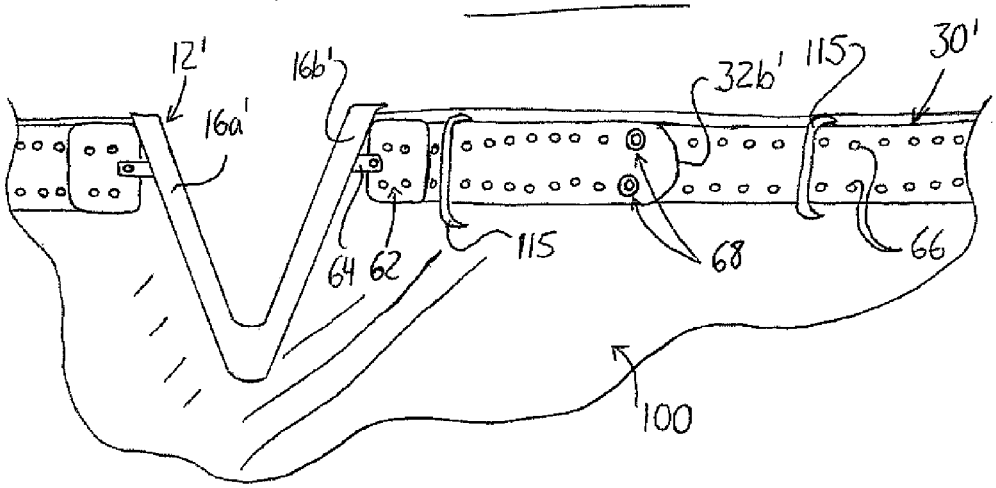
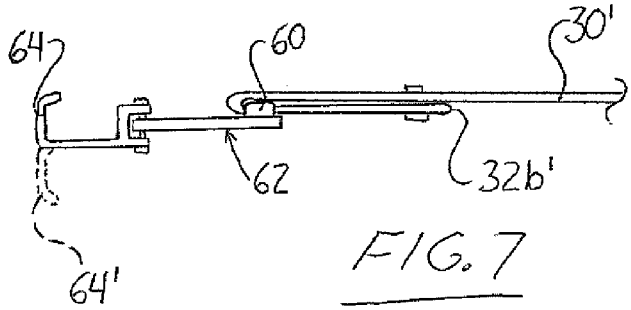
FIG. 7
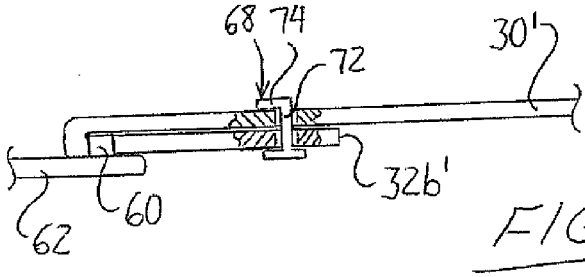
FIG. 8

GARMENT, GARMENT ACCESSORY, GARMENT BELT AND COMBINATIONS OF SAME

FIELD OF THE INVENTION

The present invention relates generally to garments, and more particularly to a V-shaped garment accessory that can be worn, on its own or as a waist belt closure member, in alignment with boundaries of an open triangular notch in the waist of a corresponding garment in order to provide a unique visual effect.

BACKGROUND OF THE INVENTION

Clothing garments which cover the lower extremities of the human torso are held in place by some type of securing system. The most common method is through the use of a belt and belt buckle. The belt serves functionality as its primary purpose is to hold a loose fitting garment in place. Modern stretch fabrics may not require the use of a belt and buckle but these items also serve as a major aesthetic fashion accessory. Both belt and belt buckle come in many shapes, sizes, designs, and materials.

The basic design of belt and buckle has not radically changed since inception. But fashion, style and accessories have changed and gained significant market traction over the years. The trend to low cut, ultra low cut, and Brazilian jean styles have led to the exposure of more skin in the midriff area of the body. The trend is most significant with females. The traditional design of belt and buckle do not impede this trend but they also do not add aesthetic value to this trend.

Women who follow fashion desire garments and accessories which typically allude to emphasize their natural form and create a visual impact for others to witness. Hence terms such as beauty and sexuality are synonymous with both fashion and certain amounts of skin exposed in appropriate places and amounts. Cleavage, legs, and midriff, both front and back, are primary examples of such exposure.

One challenge is therefore to design a belt and buckle system which serves functionality by way of securing waist type garments in place while adding a visual component by way of a buckle design to expose skin in a revealing manner. The garment and accessory designs disclosed herein accomplish this and other objects, including the addition of further aesthetic appeal through additional incorporation of an aesthetic jewellery component within belt buckle components of some embodiments.

SUMMARY OF THE INVENTION

According to a first aspect of the invention there is provided a garment belt comprising:

an elongated strap having a length defined between a first effective end of the elongated strap end and a second effective end of the elongated strap;

a V-shaped closure member comprising a first leg and a second leg, the first and second legs being interconnected at joined ends thereof and diverging from one another away from the joined ends;

a first connection between the first effective end of the elongated strap and the first leg of the closure member; and a second connection between the second effective end of the elongated strap and the second leg of the closure member;

a waist loop being defined by the elongated strap, the V-shaped closure member and the first and second connections therebetween.

Preferably the length of the elongated strap is adjustable.

Preferably at least the first effective end of the elongated strap is defined by a respective folded-over end thereof.

Preferably a distance by which the elongated strap folds back over itself at the respective folded-over end thereof is adjustable.

Preferably a plurality of attachment points are defined at spaced positions along the elongated strap and a fastening element on the folded over end of the elongated strap is operable to attach the folded over end to any selected one of the attachment points.

Preferably each attachment point comprises a hole in the elongated strap, through which the fastening element can be engaged.

Preferably each fastening element comprising an L-shaped projection carried on the folded-over end to hook through the hole of the selected one of the attachment points.

Preferably the first connection comprises a strap segment having a shorter length than the elongated strap, the strap segment being connected to the first leg of the closure member and comprising a loop through which the folded end of the elongated strap passes to fold the elongated strap back over itself.

Preferably the first connection is releasably engaged between the closure member and the elongated strap to allow selective disconnection thereof.

Preferably the first connection comprises a hook.

Preferably the first connection is releasably engaged to the closure member at a slot defined on the first leg thereof.

Preferably a securing element is carried on one of the legs of the closure member for engagement with a garment at a position thereon at which the closure member is to be disposed when worn with the garment.

Preferably the securing element comprises a pin.

Preferably the one of the legs on which the pin is defined extends parallel thereto.

Preferably there is provided an ornament carried on the closure member between the first and second legs thereof.

Preferably the ornament is suspended from the first and second legs of the closure member at a distance from the joined ends thereof.

Preferably there are provided flexible supports suspending the ornament from the first and second legs of the closure member.

Preferably the ornament is detachable from the closure member for interchanging with another ornament.

Preferably each flexible support comprises chain equipped with a clasp for selective engagement to and disengagement from the closure member.

The garment belt is preferably used in combination with a garment to be worn about a wearer's waist, the garment having a waist portion defining a waist opening at an upper boundary thereof and having an open notch depending into the waist portion from the upper boundary thereof so that sides of the open notch converge downwardly from the upper boundary of the waist portion to meet at a distance therebelow, the closure member being positionable over the garment to align an open space between the legs of the closure member with the open notch in the garment to expose skin of the wearer through the aligned space and open notch when worn in alignment.

The garment may comprise a fly extending downwardly away from the open notch beneath where the sides thereof meet below the upper boundary of the waist portion.

Preferably the garment and the closure member are coupled together proximate to the open notch in the garment.

Preferably a boundary portion of the garment surrounding the open notch therein carries at least one capturing element enagable with a respective securing element of the closure member to secure the closure member to the garment at the open notch therein.

The at least one capturing element and respective securing element may comprise a magnet and magnetically attractable material carried on opposite ones of the garment and the V-shaped closure.

Preferably the at least one capturing element comprises a channel extending along one side of the notch and the respective securing element comprises a pin carried on a respective one of the legs of the closure member and dimensioned for receipt within the channel. The channel may comprise a folded-over portion of garment at the one side of the open notch.

The combination preferably comprises a V-shaped body of different material than the garment fitted onto the garment to border the open notch therein.

The garment may comprise a fly extending downwardly from the upper boundary of the waist portion along one side of the open notch therein and continuing further downward from the notch beneath where the sides thereof meet below the upper boundary of the waist portion, and opening of the fly enables a portion of the garment in which the notch is formed to be folded away from an opposing side of the fly.

The garment may comprise markings carried thereon proximate the open notch, the V-shaped closure member visually defining a letter V visible together with the markings to form a name or logo when worn in alignment with the notch.

According to a second aspect of the invention there is provided a garment to be worn about a wearer's waist, the garment comprising:

a front side;

a rear side;

a waist portion defining a waist opening at an upper boundary thereof; and an open notch depending into the waist portion from the upper boundary thereof on the front side of the garment, sides of the open notch converging downwardly from the upper boundary of the waist portion to meet at a distance therebelow.

According to a third aspect of the invention there is provided a garment and accessory combination comprising:

a garment having a front side, a rear side, a waist portion defining a waist opening at an upper boundary thereof; and at least one open notch depending into the waist portion from the upper boundary thereof with sides of the open notch converging downwardly from the upper boundary of the waist portion to meet at a distance therebelow; and a V-shaped accessory member comprising a first leg and a second leg, the first and second legs being interconnected at joined ends thereof and diverging from one another away from the joined ends; the closure member being wearable on the garment in a position aligning an open space between the legs of the closure member with the open notch in the garment to expose skin of the wearer through the aligned space and open notch when worn in alignment.

According to a fourth aspect of the invention there is provided a garment comprising:

a garment body having a front side, a rear side, a waist portion defining a waist opening at an upper boundary thereof; and at least one open notch depending into the waist portion from the upper boundary thereof with sides of the open notch converging downwardly from the upper boundary of the waist portion to meet at a distance therebelow; and a V-shaped body of different material and greater rigidity than the garment body and fitted onto the garment body to border the open notch therein.

The garment is preferably used in combination with a V-shaped accessory wearable on the garment in a position aligning an open space between the legs of the closure member with the open notch in the garment to expose skin of the wearer through the aligned space and open notch when worn in alignment.

According to a fourth aspect of the invention there is provided a garment accessory comprising:

a V-shaped member comprising a first leg and a second leg, the first and second legs being interconnected at joined ends thereof and diverging from one another away from the joined ends;

at least one securing element on the V-shape member for engagement with a garment to support the garment accessory thereon; and first and second support elements on the first and second leg of the V-shaped member respectively for selective releaseable engagement with an ornament to selectively suspend the ornament in a position between the first and second legs of the V-shaped member at position over the joined ends thereof.

BRIEF DESCRIPTION OF THE DRAWINGS

In the accompanying drawings, which illustrate a exemplary embodiments of the present invention:

FIG. 2 is a side elevation view of a closure member of the garment belt of FIG. 1.

FIG. 3 is a rear elevation view of the closure member of FIG. 2.

FIG. 4 is an enlarged partial rear elevational view of the closure member of FIG. 3.

FIG. 6 is a partial front elevational view of the second embodiment garment belt as adorned by the wearer.

FIG. 7 is an overhead view of a hook-equipped strap segment used to interconnect a longer main strap of the second embodiment garment belt with the closure member thereof to effect closing of the belt when worn.

FIG. 8 shows an enlarged portion of FIG. 7 partially cut away to illustrat how the main strap is connected to the shorter strap segment using a folded-over end portion of the main strap that also allows adjustment of the length of the main strap to resize the belt for fitting about the wearer's waist.

FIG. 11 is a partial front elevational view of a garment according to a third embodiment of the present invention.

FIG. 12 is a partial rear elevational view of the garment of FIG. 11 when worn.

FIG. 13 is a partial front elevational view of the garment of FIG. 11 when worn.

FIG. 14 is a partial side elevational view of the garment of FIG. 11 when worn.

DETAILED DESCRIPTION

Figure 1:
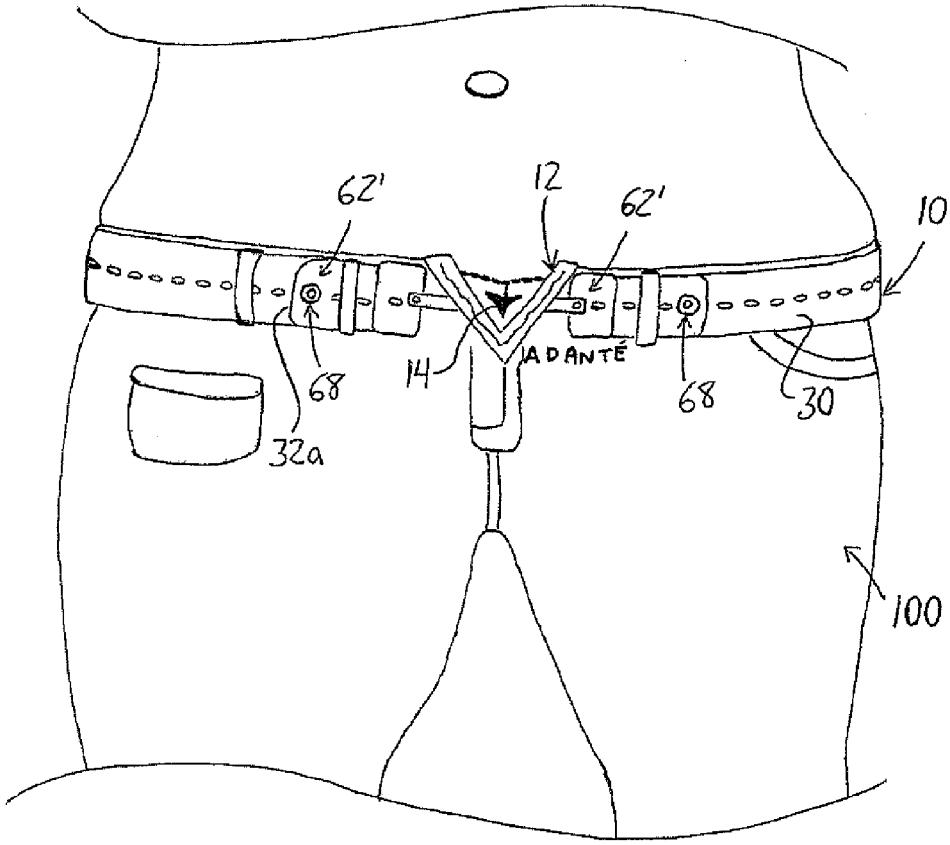
FIG. 1 is a front elevational view of a garment and garment belt of a first embodiment of the present invention in combination as adorned by a wearer.

FIG. 1 shows a garment belt 10 and accompanying pair of jeans 100 of the present invention. The belt 10 features a V-shaped closure member 12 in place of a conventional belt buckle and is worn about the waist of the jeans 100 in such a position to align the open space between the diverging legs of the V with an inverted triangular notch formed in the jeans at the upper boundary of the waist. This results in exposure of a triangular area of skin conventionally concealed behind the waist of a garment, resulting in a unique appearance. As shown, the V-shaped closure member may be equipped with a piece of ornamental jewelry 14 suspended between the upward projecting legs of the V against the backdrop provided by the wearer's skin.

The closure member 12 of the first embodiment is shown in greater detail in FIGS. 2 to 4. The closure member 12 is made of metal or other rigid material and features two linearly extending legs 16*a*, 16*b* of equal length diverging upwardly away from one another at an acute oblique angle to leave an inverted triangular space between them above their integrally connected bottom ends. A front face of the closure member faces away from the wearer when the belt is adorned, and is illustrated as flat or planar in the first embodiment drawings, but may have other shaped or contoured surfaces as demonstrated by the cross sectional view of the second embodiment in FIG. 9. The first leg 16*a* of the closure member features a securing pin 18 fixed to a flat rear face of the leg 16*a* opposite and parallel to the front face thereof. An upper end portion 18*a* of the pin 18 is rigidly fixed to the first leg 16*a* proximate an upper end thereof, leaving a free lower shaft portion 18*b* of the pin that projects downward along the first leg 16*a* in a direction parallel thereto at a short distance from the flat rear face thereof, leaving a gap G between the pin and the closure member except at the connection of the two at the top ends thereof.

Referring to FIG. 2, a first side slot 20*a* is provided in the first leg 16*a* of the closure member 12 and has a depth extending thereinto from an outer side thereof opposite the second leg 16*b*. A first rear slot 22*a* is also provided in the first leg 16*a* and has a depth extending thereinto, but not fully therethrough, from the rear face of the closure member 12. The depths of these two slots are such that the two slots communicate fully with one another inside the first leg 16*a* of the closure member to define a right-angle L-shaped passage extending through the first leg 16*a*, entering from the outer side of the first leg 16*a* and then exiting through the rear face thereof. The securing pin 18 lies adjacent the inner side of the first leg 16*a* nearest the second leg 16*b*, which leaves room for the first rear slot 22*a* at a position between the pin 18 and outer side of the first leg 16*a*, as shown in FIGS. 3 and 4. The communicating slots 20*a*, 22*a* in the first leg 16*a* leave a portion 24*a* of the first leg 16*a* in place along the outer side and rear face of the first leg 16*a* between the full-width portions of the first leg's rear face left intact fully across the first leg above and below the rear slot 22*a* therein.

A second side slot 20*b* is provided in the second leg 16*b* of the closure member 12 and has a depth extending thereinto from an outer side thereof opposite the first leg 16*a*. A second rear slot 22*b* is also provided in the second leg 16*b* and has a depth extending thereinto, but not fully therethrough, from the rear face of the closure member 12. The depths of these two slots are such that the two slots communicate fully with one another inside the second leg 16*b* of the closure member to define a right-angle L-shaped passage extending through the second leg 16*b*, entering from the outer side of the first leg 16*b* and then exiting through the rear face thereof. The communicating slots 20*b*, 22*b* in the second leg 16*b* leave a portion 24*b* of the second leg 16*b* in place along the outer side and rear face of the second leg 16*a* between the full-width portions of the second leg's rear face left intact fully across the second leg above and below the rear slot 22*b* therein.

With reference to FIGS. 3 and 4, the slots 20*a*, 22*a* in the first leg 16*a* and the passage defined thereby are positioned between the top and bottom ends of the first leg at distances along the leg from these two ends, and are aligned with the slots 20*b*, 22*b* in the second leg 16*b* across an axis of symmetry of the closure member's V-shape. Accordingly, as shown in FIG. 3, the slots 20*b*, 22*b* in the second leg 16*b* are likewise positioned between, but upward and downward from, the bottom and top ends of the second leg at the same distances from these ends of legs as the slots 20*a*, 22*a* in the first leg 16*a*. The opening defined by each rear slot in the respective leg has its length arranged parallel to the axis of symmetry of the V-shape so that the lengthwise sides defined by the opening's slot-like shape in the illustrated embodiment are oriented vertically when the V-shaped closure member is oriented upright with its axis of symmetry lying vertical.

A small first loop 28*a* is defined proximate the top end of the first leg 16*a* of the closure member 12, a corresponding small second loop 28*a* is defined proximate the top end of the second leg 16*a* of the closure member 12. In the first embodiment, each of these small loops is defined by a respective half-link of chain having its free ends fixed to the flat rear surface of the closure member so that the curved end of the half-link opposite the free ends thereof projects a short distance into the area between the legs of the V. In FIG. 3, the first loop 28*a* is defined by a half-link of chain rigidly fastened to the first leg's rear surface beside or at the fixed portion 18*a* of the pin 18 on the first leg 16*a* and the second loop 28*b* is defined by a half-link of chain rigidly fastened to the rear flat face of the second leg at position aligned with the first loop 28*a* across the plane of symmetry between the two legs of the V. The first half-link of chain thus cooperates with the first leg's rear face or with fixed portion 18*a* of the pin 18 to define the first closed loop 28*a* defining an opening at or a short distance behind the plane of the rear face of the closure member, with the second half-link of chain likewise cooperating with the rear face of the second leg to define the second closed loop 28*b* defining an opening at the plane of the rear face of the closure member.

With reference to FIG. 1, the belt 10 features a one piece main belt strap 30 cooperable with connections of this strap to the closure member to form a sizable closed loop to be worn about the waist of the user. The elongate main strap 30 is a single unitary member having two opposing free ends 32*a*, 32*b*, which in a manner described herein further below, can each be folded back over the remainder of the main belt strap to form a folded-over end portion thereof useful in establishing connection of the resulting effective end of the strap to the respective leg of the V-shaped closure member.

Figure 10:
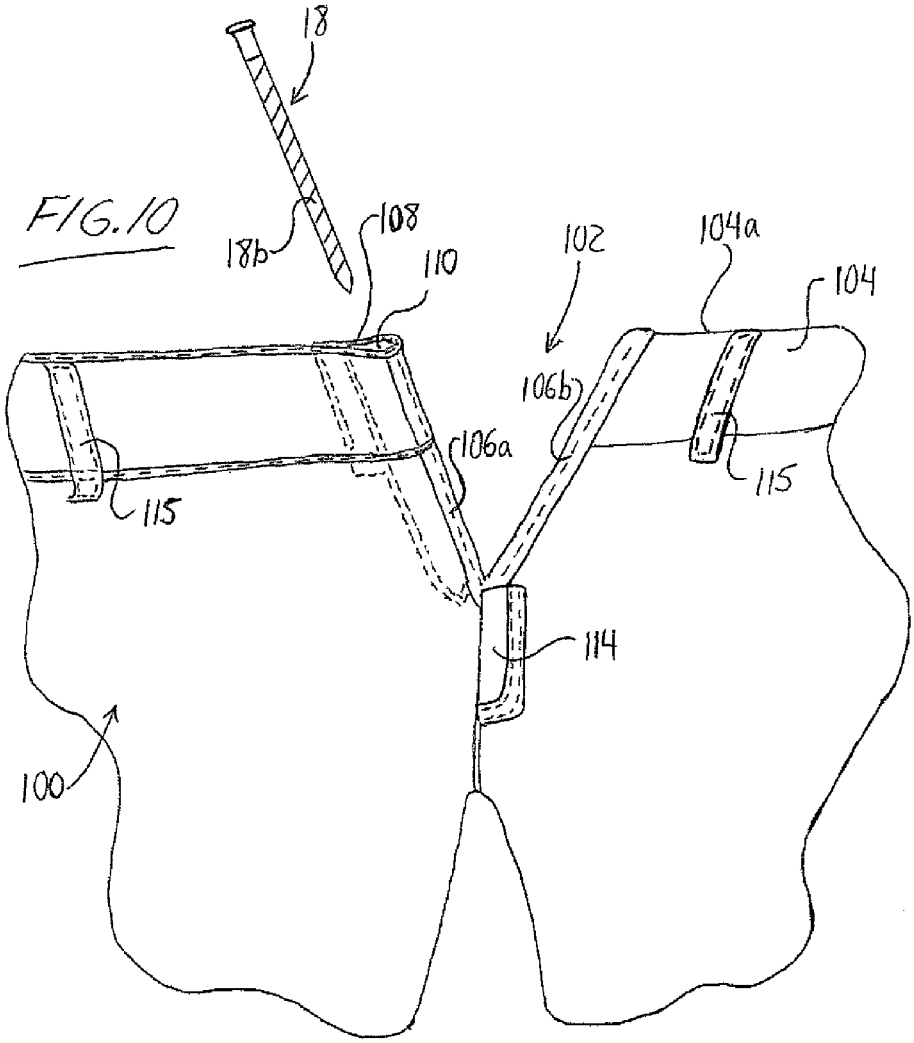
FIG. 10 is a partial front elevational view of the garment of FIG. 1 with the garment belt removed, but showing a securing pin of the belt's closure member to illustrate connection thereof to the garment.

FIG. 10 shows the jeans 100 having an open notch 102 of inverted triangular shape depending downward into the garment from the upper boundary 104*a* of the waist 104 thereof. The waist portion 104 defines a waist opening as in a conventional garment, but due to the notch 102, the upper boundary 104*a* of the waist portion does not fully enclose around this waist opening as it would in a conventional pair of jeans when the fly thereof is closed. Described in terms of its appearance when the garment is worn or laid out flat, the notch 102 features obliquely sloped first and second sides 106*a*, 106*b* the converge downwardly from the upper boundary 104*a* of the garment's waist to meet at a distance downward therefrom. The angle between the sides 106*a*, 106*b* of the notch 102 is equal to the angle between the legs 16*a*, 16*b* of the belt's closure member 12 and the equal length of the closure member's two legs 16*a*, 16*b* is generally equal to or slightly greater than the length of the notch's two sides 106*a*, 106. Accordingly, the open area between the legs of the closure member can be aligned with the triangular open notch 102 in the jeans so that the legs of the closure member overlie or cover the sides of the notch 102 and an open window to a triangular section of the wearer's skin is provided by these aligned open spaces.

As shown in FIG. 10, the jeans 100 are internally folded over at the first side 106*a* of the notch 102, with this folded-over flap 108 of the jeans 100 being sewn back onto the jeans at a distance laterally outward from the notch 102 along a line parallel to the first side 106*a* thereof so that this folded over portion of the jeans defines a tunnel-like or tubular passage 110 extending downward from the upper boundary 104*a* of the waist along the first side 106*a* of the notch 102. To releaseably secure the closure member 12 of the belt 10 to the jeans 100, the free shaft portion 18*b* of the securing pin 18 of the closure member 12 is inserted into the tubular passage 110 from above. The closure member is seated on the jeans either by contact of the free end of the pin 18 with a sewn-closed bottom end of the tubular passage 110, or hanging of the rigid connection between the fixed portion 18*a* of the pin and the rear of the closure member over the side of the tubular passage 110 at the front of the jeans. The receipt of the pin in a bore-like tubular passage, the front wall of which is accommodated by the gap G between the pin and the closure member's rear face, establishes a pivotal or swiveling connection between the closure member and the jeans. In the illustrated embodiment, the pin 18 extends nearly a full length of the first leg of the closure member and the tubular passage 110 extends a full length of the first side boundary of the notch 102 to maximize the length of the pivotal connection established by these two elements and thereby minimize the chance of inadvertent withdrawal of the pin 18 from the passage 110 during manual pivoting of the pin and closure member relative to the jeans.

The jeans are equipped with a zipper or button fly 114, the opening of which communicates with the bottom point of the notch 102 so that when the zipper or button fastening arrangement of the fly is disengaged, the open fly enlarges the opening at the front of the jeans from that otherwise only provided by the notch. As a result of the notch 102, the fly is of a shorter length than a conventional pair of jeans having same rise (distance between the waistline and the crotch). The jeans are also provided with conventional belt loops 115 on the waist portion at spaced positions therealong about the waist opening. When a wearer of the belt wishes to open the fly, first the second effective end of the main belt strap 30 defined by the folded-over second free end 32*b* thereof is disconnected from the second leg of the closure member, which releases the second leg of the closure member from its previously secured position against the front of the jeans adjacent the second side of the notch. The closure member is then pivoted out of the closed position to move the second leg away from the second side of the notch and swing it over to the first side of the notch, thereby freeing up access to the top of the fly 114 at the bottom of the notch 102. In a conventional manner, the belt loops of the jeans hold the strap of the belt on the jeans during this process.

Complete removal of the belt starts with a similar initial process, first disconnecting the second effective end of the main strap 30 from the closure member. The closure member is then lifted in an oblique direction parallel to the first side of the notch 102 in order to lift the pin 18 fully out of the tubular passage 110, thereby releasing the first leg of the closure member from the jeans to free the closure member from all direct connection thereto. The strap assembly of the belt can then be removed from the jeans by pulling the closure member, still secured to the first folded end portion of the main strap, to pull the free second end of the main strap around the waist of the jeans to draw the entire strap assembly out of the belt loops thereon. Alternatively, the first effective end of the strap may also be detached from the closure member in same manner as the second effective end, in which case the strap assembly can then be drawn out of the belt loops by pulling of either free end of the strap, with the closure member either still in place on the jeans or having been removed therefrom by withdrawal of the pin. The first option may be preferable in some cases, as it allows later re-use of the belt with the same or a different garment without having to reconnect the first leg of the closure member with the strap assembly, but in other cases it may be advantageous to completely separate the strap assembly and closure member or be necessary to do so in order to allow withdrawal of the closure member pin from the tubular passage of the jeans. Such separation would allow substitution of the strap assembly or closure member for another of different appearance, thereby allowing different combinations of straps and closure members having a different shapes, colours, patterns, designs, ornamentation.

Figure 5:
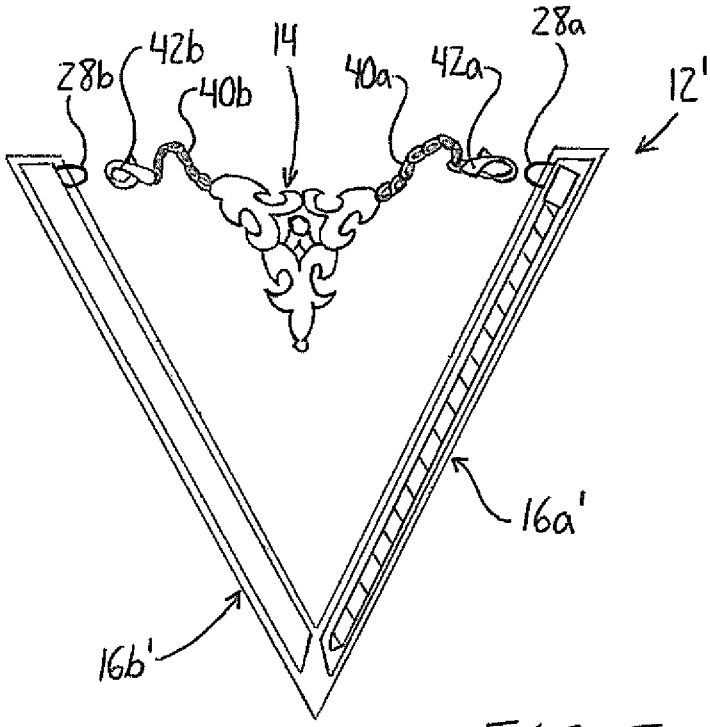
FIG. 5 is a rear elevational view of the closure member of a second embodiment garment belt of the present invention.

FIG. 5, showing the closure member 12' of a second embodiment garment belt 10', illustrates how an ornamental piece of jewelry 14' is suspended between the legs of the V-shaped closure member. The jewelry piece 14' has short lengths of flexible jewelry chain fastened to opposite sides thereof and carrying jewelry clasps at ends of the chain lengths opposite the jewelry piece for selective fastening to the first and second loops 28*a*, 28*b* on the closure member to hang the jewelry thereon. A first chain length 40*a* extends from a first side of the jewelry piece nearest the first leg 16*a'* of the closure member 12', carries a first clasp 42*a* at its end opposite its connection to the jewelry piece and is of sufficient length to reach the first loop 28*a* on the first leg 16*a'* when the jewelry piece 14*a* is centered over the joined bottom ends of the legs at a distance thereabove. Likewise, a second chain length 40*b* extends from a second side of the jewelry piece nearest the second leg 16*b'* of the closure member 12', carries a second clasp 42*b* at its end opposite its connection to the jewelry piece and is of sufficient length to reach the second loop 28*b* on the second leg 16*b'*. When the clasps are connected to the hanging loops 28*a*, 28*b* on the closure member, the jewelry is suspended from near the top ends of the legs of the V-shaped member to hang over the closed bottom of the V-shape.

As illustrated by the first embodiment in FIG. 1, the two lengths of chain may be replaced by a single chain having clasps at both ends, in which case an ornamental piece may be suspended from the single chain, preferably at a central position therealong. Alternatively, the chain itself may form the only jewelry or ornament suspended on the closure member. The use of clasps or other releasable fasteners allows interchanging of different jewelry or ornaments on the closure member. Non-flexible supports may alternatively be used to position an ornamental component between the legs of the V, but use of chain or other flexible support with a degree of slack in the suspension of an ornamental jewelry piece allows movement of the piece, which may add to the eye catching attraction provided thereby. It will be appreciated that hook engagable openings may be provided for connection thereto by jewelry clasps or hooks in ways other than by full or partial links secured to the closure member, for example by using through holes passing through the legs of the V-shaped closure member from the front surface of each leg to the opposing rear surface thereof. In another embodiment, the clasps or hooks may be provided on the V-shaped member to engage through links, loops or other openings in the jewelry piece or assembly to be suspended between the legs of the V.

The second embodiment closure member 12' does not use slots in the V-shaped closure member to effect the connection between the strap assembly and the closure member. Instead, with reference to FIGS. 5 and 9, the closure member 12' features replacement of the slots with raised profiles 50*a*, 50*b* projecting from the otherwise flat rear surfaces of the V-members legs and extending over the substantially full length thereof. In cross-section (see the horizontal section of FIG. 9 where the where the V-shaped closure member lies in a vertical plane perpendicular to a vertical plane of symmetry between the legs), each profile 50*a*, 50*b* features a first portion 52*a*, 52*b* projecting perpendicularly from the rear surface of the respective V-leg 16*a*', 16*b*' and a planar flange or ledge portion 54*a*, 54*b* projecting laterally outward from the first portion 52*a*, 52*b* at a distance from the V-leg's rear face in a direction parallel thereto. The first portion 32*a*, 52*b* of each profile 50*a*, 50*b* extends past where the flange portion 54*as*, 54*b* projects out in order to present a flat rear face 56*a*, 56*b* parallel to that of the respective V-leg 16*a*', 16*b*'. The pin 18' of the second embodiment is fixed to the rear surface 56*a* of the raised profile 50*a* on the rear surface of the first leg 16*a*' proximate the upper end thereof to extend along the rear surface of the profile a short distance therefrom in a manner corresponding to the relative positioning of the first embodiment pin to the V-leg rear face thereof.

Figure 9:
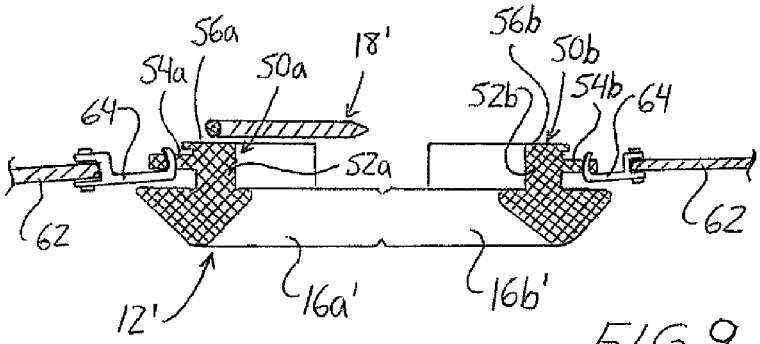
FIG. 9 is an overhead view in horizontal cross section of the closure member of the second embodiment garment belt to illustrate connection of the closure member between two strap segments secured at opposite effective ends of the main strap to close the belt around the wearer's waist.

Referring to FIGS. 6 to 8 to describe connections between the main strap of the belt and the closure member, each end 32*a*', 32*b*' of the second embodiment belt strap 30' is folded back over the rest of the strap. The resulting folded over end portion of the main belt strap 30' passes through a belt loop 60 defined on a rear or inner face of strap segment 62 of significantly smaller length than the main strap 30', but of similar or equal width and thickness thereto. The belt loop 60 extends across the rear of the strap segment 62 proximate one end thereof and a J-shaped hook 64 is riveted or otherwise secured to the strap segment 62 adjacent the opposite end thereof so as to project longitudinally therefrom in a direction opposite which the main strap 30 extends when folded and passed through the belt loop 60. Referring to FIGS. 6 and 9, with the main strap 30' and strap segment 62 secured together by fastening of the folded end portion of the main strap to itself after passing through the belt loop 60 on the strap segment 62, the effective end of the main strap defined at the fold of it's folded over end portion is connected to the respective leg of the V-shaped closure member 12' via the strap segment 62 by engaging the free end of the J-shaped hook member 64 through a hole or slot in the flange-portions 54*a*, 54*b* of the raised profile 50*a*, 50*b* on the back of the respective V-leg 16*a*, 16*b*.

As shown in FIG. 6, the main strap 30' of the belt features two parallel rows of holes 66, each row extending in the longitudinal direction of the strap at a respective position spaced from the other row over the width of the strap, and each hole in each row aligning with a respective hole in the other row along the strap. The spacing between each two adjacent holes in each row is equal. Accordingly, when an end of the main strap 32*b*' is folded back over the rest of the main strap 30 to form the effective end of the main strap where it bends through the belt loop 60 on the respective strap segment 62 as shown in FIG. 7, a hole in the folded-over end portion of the main strap can be aligned with a respective hole in the same row in the portion of the main strap over which the end 32*b*' has been folded. Due to the aligning of the holes in the two rows with one another and the equal inter-hole spacing in each row, this also aligns two holes in the other row where the strap is folded over.

With reference to FIG. 8, a respective fastening stud 68 is passed through the two aligned hole in each row to secure the end of the main strap in a fixed position along the remainder thereof, thereby fixing the length of the folded over end portion of the main strap and accordingly contributing to the overall effective length of the main strap. The fastening stud 68 features a generally flat disc-like head 70 of circular or other planar shape, and a stem 72 projecting perpendicularly from one face of the head 70 to carry a perpendicular leg 74 projecting laterally from the end of the stem opposite the head in a plane parallel thereto. Accordingly, the stem and leg 74 combine to define an L-shaped portion of the stud 68 fixed to the head 70 thereof. With the folded over end portion of the main strap 30' placed face to face against the remainder of the strap with holes of these two portions aligned, the L-shape of the stud 68 can accordingly be hooked through the aligned holes to situated the head 70 flat against the front outer side of the folded-over end portion and tuck the leg 74 in behind the rear inner side of the main strap 30'.

The holes in the belt thus provide an array of selectable fastening points at which the folded-over end of the belt can be secured to itself to allow selection of different belt strap lengths. When the belt is worn, this sizing of the main strap by is used to control the overall size of the belt formed by the interconnected main strap, strap segments and closure member. That is, lengthening the folded-over end portion of the main strap shortens the effective overall length of the main strap to tighten the belt, and shortening the folded-over end portion lengthens the strap assembly and loosens the belt.

With reference to FIG. 1, the first embodiment uses strap segments 62' that are similar to those of the second embodiment, except that the J-shaped hooks 64' are each flipped in orientation relative to the plane of the respective strap segment so that the curved hook end of the J bends to the front or outer side of the belt segment from its connection to the linear stem of the J-shape, as shown in broken lines in FIG. 7. Each J-shaped hook 64' of the first embodiment is hooked to the respective leg of the V-shaped closure member 12 by hooking the curved hook end into the respective leg through the rear slot 22*a*, 22*b* therein so that the hook catches on the intact portion 24*a*, 24*b* of the rear legs face that covers the respective side slot 20*a*. The only other difference between the main strap 30 and strap segments 62 of the first embodiment and those of the second embodiment is that these components of the resulting strap assembly each feature only a single row of fastener holes, and so a only a single fastening stud 68 is employed at each folded over end portion of the main strap 30 to secure it in place for a selected resulting belt size.

It will be appreciated that where holes are used to define attachment points, number of hole rows may be increased from the one row of the first embodiment or two rows of the second embodiment. It will also be appreciated that other fastener types could instead be used in the size adjustment and strap segment connection provided by the fastenable folding over the strap end, and such alternatives may or may not employ fastening holes through the belt strap.

Also, it will be appreciated that the connection between the main belt strap and the closure member could be achieved by means other than the illustrated strap segments and hook-type attachments to the closure member. For example, an alternative embodiment may employ a one-piece belt strap in place of the multi-segment strap assembly of the illustrated embodiments, and use longer versions of the side and rear slots of the first embodiment closure member to enable wrapping of each free end of the belt strap through the passage in the respective leg defined by the slots therein so that the end portion of the belt may be once again folded back over and fastened to itself, but do so through the respective leg of the closure member to achieve a connection thereto. Having the rear slot extend at an oblique angle relative to the lengthwise axis of the respective leg so that the slot is vertical with the closure member upright may be preferable to ensure that the belt strap folds along an axis generally perpendicular to its length when fed through the passage, so as to align back over itself when folded, and to direct the pulling force exerted on the closure member under tightening of the belt in the direction in which the belt travels around the wearer's waist.

That is, a first of the strap ends would be connected to the first leg of the closure member by first passing it into the first leg through the first rear slot therein and then onward through the first side slot to exit the outer side of the first leg. The longer length of the slots compared to the illustrated embodiment would be sufficient to accommodate the width the of the belt strap. The first free end of the strap would then be pulled back along the rest of the strap to form a first folded-over end portion of the strap that reverses direction in its passage through the first leg of the closure member, thereby wrapping around the portion of the leg's rear surface left intact outside the rear slot. To close the belt, the second free end would likewise be engaged to the second leg of the closure member, so that the strap and the closure member collectively define a closed waist loop. That is, the second free end would first be passed it into the second leg through the second rear slot and then onward through the second side slot to exit the outer side of the second leg. The second free end of the strap would then be pulled back along the rest of the strap to form a second folded-over end portion of the strap that reverses direction in its passage through the second leg of the closure member, thereby wrapping around the portion of the leg's rear surface left intact outside the rear slot of the second leg.

The two folded-over end portions of the strap would form effective ends of the strap that are interconnected with the closure member by their travel through the direction-changing passages in the legs of the closure member. The overall size of the resulting loop closed by the interconnection of the effective ends of the strap by the closure member could be adjusted by changing the length by which one or both of the folded-over end portions extend back along the remainder of the strap. That is, when positioned about the intended wearer's waist with the first folded over end portion secured in place on the remainder of the strap to fix the distance by which the first folded-over end portion extends therealong, the belt could be tightened by pulling the second free end of the strap further along the remainder of the strap to increase the overlap of the second fold-over end portion with the remainder of the strap. This increases the length of the second folded-over portion, thereby decreasing the effective length of the strap defined by the remainder of the strap left between the effective strap ends defined where the strap folds through the closure member. With the desired tightness achieved, the second folded-over portion would then be secured in place at the desired position along the remainder of the strap to fix the effective length or tightness of the belt until the belt needs to be adjusted in size, opened or removed. If the user prefers a more symmetric look, the tightening or sizing of the belt can be achieved by adjusting the length of both folded-over end portions in this manner until they have equal or near-equal lengths that provide the desired effective size or length of the remaining unfolded central portion of the strap between the effective ends at the folding of the strap.

FIGS. 11 to 14 show a second embodiment pair of jeans 100' that again feature an inverted triangular notch 102 in the front waist portion like the preceding garment embodiment, but differ in the configuration of the fly and the pin-receiving passage around this notch and in the addition of further notches at other locations spaced around the waist portion of the jeans.

Referring to FIG. 11, a V-shaped metal attachment 121 is fixed to the jeans at the sides of the notch 102 and presents two linearly extending attachment legs connected together at one end and diverging away from their connection at the same angle as the legs of the closure member and the sides of the notch 102 in the jeans. A fly 115 is provided in jeans in the shape of a half-Y having a linear stem extending upwardly away from the crotch of jeans toward the pointed bottom of the notch 102 in the waist and a linear branch extending obliquely from the top end of the first branch parallel to a respective side of the triangular notch 102, and corresponding leg of the attachment 121, at a short distance laterally outward therefrom. The illustrated embodiment has a zipper fly that is openable and closeable over most of its length by a zipper 115*a* and uses a button 117 at the top of the fly to secure closing of a fabric flap 116 of the fly structure over the zipper 115*a* when the fly is to be closed. The flap 116 is Y-shaped, having two branch portions 116*a*, 116*b* diverging obliquely away from one another on opposite sides of the notch 102 and attachment at the same angle of divergence as the sides of the notch and legs of the attachment. A stem portion 116*c* of the flap 116 defining the stern or base of its Y-shape extends downward from the connected ends of the branch portions 116*a*, 116*b* along the stem of the of the zipper's half-Y shape. The stem portion 116*c* and one of the branch portions 116*b* of the flap 116 are sewn to the rest of the jeans along outer edges of the flap to one side of the notch 102 and the V-shaped attachment 121, as shown at 116*d*.

Each leg of the V-shaped attachment 121 has a U-shaped cross section so as to present a respective slot 118*a*, 118*b* between a respective pair of plate-like portions of the leg. To install the attachment 121, the inside edge of the branch 116*b* of the flap that is (or will be) sewn the rest of the jeans is received in the slot 118*b* of the respective leg of the attachment 121 along with the edge of the jeans at the respective side of the notch. The inside edge of the other branch 116*a* of the flap is received within the slot 118*a* of the other leg of the attachment 121. The plate-like portions of each leg are compressed together to sandwich the denim between them, and rivets 119 are engaged through the opposing plate faces of each leg of the attachment to complete the secure permanent fastening of the attachment onto the flap and the remainder or body of the jeans. A button hole is provided in the branch 116*a* of the flap 116 opposite that sewn to the body of the jeans at a position near the top end of this unsewn branch between the respective leg of the attachment 121 and the outer edge of the flap. Accordingly, when the flap is closed over the fly 115, the male button 117 fixed to the body of the jeans just below the upper boundary of the waist thereof beside the fly opening aligns with the button hole so as to be engagable therethrough to secure the flap in this closed position covering the fly opening and zipper.

A channel 120 is formed in the leg of the attachment 121 fixed on the sewn branch 116*b* of the flap 116 between the slot 118*b* therein and the bent or curved end of the leg's U-shape integrally connecting the plate-like portions of the attachment, which are now fixedly disposed on the inside and outside of the jeans, at the respective side of the notch 102. This channel 120 extends linearly along the leg of the attachment 120 from the top end thereof toward the bottom end thereof where the two attachment legs join, and thus extends along the respective side of the notch along a line parallel thereto in order to replace the passage 110 defined in the first embodiment jeans by a folded-over fabric portion thereof. This channel or passage 120 is dimensioned to accommodate sliding of the pin 18, 18' of the belt closure member 12, 12' of the forgoing embodiments in the same manner previously described to support closure member on the jeans and allow pivoting of the closure member into and out of a closed position worn over the notch boundaries, which in this embodiment positions the closure member over the attachment 121 in covering alignment therewith. With the pin insertion achieving the selective coupling between the attachment member and the closure member, the attachment thus provides female V-shaped accepting plates compression fitted onto the garment and matable with a V-shaped male belt-closure member.

With the first embodiment jeans 100, the belt closure member 12, 12' pivotally suspended on the jeans was held in place in the closed or wearing position in alignment over the notch 102 in the jeans by the connection of the respective effective end of the belt strap 30 to the second leg 16*b* of closure member opposite the pin-carrying pivotally-supported first leg 16*a*. For use with the jeans 100' of the third embodiment, the closure member 12, 12' has a magnet mounted on, embedded in or otherwise supported on its second leg, so that when the pin of the closure member is received in the channel 120 of the V-shaped attachment 121 and the closure member is pivoted about the pin's axis to close the rearmost face the closure member's other leg up against the outer front face plate of the attachment on the outside of the jeans at the boundary of the notch, attraction between the magnet and a ferromagnetic material used to make the metal attachment 121 temporarily secures these legs of the closure member and attachment together to retain the closure member in the closed position. In other words, the magnet inserted in the flat rearmost face of the closure member leg, or otherwise mounted or carried on the member to act at this face, engages itself onto the female V-shaped accepting plate when it comes close thereto or into contact therewith.

Accordingly, the V-shaped closure member of the belt can optionally be worn on the jeans without the rest of the belt, especially where the jeans feature stretch denim and require no belt for a proper fit against the wearer's body. In another embodiment, an accessory of similar V-shaped configuration to the belt-closure member but lacking any belt-connection features can be worn with the attachment-equipped jeans. The attachment-equipped jeans could alternatively be worn without any separate V-shaped accessory or belt closure, and still provide a unique eye-catching appearance since the attachment mimics the profile of the closure member in its head-on appearance. Like the belt closure member, the V-shaped attachment may feature support loops, holes or other elements connectable with ornamental jewelry for suspension thereof between the legs of the V-shaped attachment against a backdrop of open skin behind the notch.

As shown in FIGS. 12 and 14, the jeans 100' are not limited to a waist band notch at the front of the garment, and additional or alternative notches 102', 102" may extend downward into the waist of the garment at the rear and each side thereabout, respectively. Like the described front notch, each notch may features a respective V-shaped attachment of metal or other material of greater rigidity than the flexible denim from which the remaining garment body itself is made to provide a strong base on the otherwise fabric garment for connection and support of the belt-closure or accessory.

Where magnets are used in the retention of a V-shaped closure member or accessory to the jeans, it will be appreciated that carrying of magnetically attractable material adjacent the notch in the jeans need not necessarily be provided by fastening of a V-shaped body of magnetically attractable material. For example, a V-shaped attachment could be formed substantially of other material but carry magnetically attractable material at one more portions where magnetic attraction is required, or a piece of magnetically attractable material of non-V shape could be attached directly to the jeans themselves adjacent the notch therein. Use of one or more magnets of sufficient strength or appropriate positioning may be used in embodiments employing entirely-magnetic coupling of the belt closure or accessory in place of the pin/channel pivotal connection or other releasable fastening. It will also be appreciated that the described positioning of the magnet(s) and magnetically attractable material(s) on the belt-closure/accessory and the jeans may be switched while accomplishing the same releasable coupling of the member to the garment.

The second embodiment V-shaped closure member 12' of FIGS. 5, 6 and 9 could be worn with the jeans of FIG. 10 without a belt-strap (i.e. worn as an independent accessory instead of as part of belt construction) through minor modifications of the garment and V-shaped member.

In the modified closure member, the rear face 56*b* of the profile 50*b* defined on the second leg 16*b'* of the V-shaped closure member features a raised button profile projecting even further from the front of the closure member. The button profile features a stem that projects normally from the flat rear face 56*b* of the profile 50*b* to which the strap segment's hook engages and an enlarged head formed at the distal end of the stem opposite the hook-receiving profile's rear face 56*b*. The head of the button profile projects outward from the stem on all sides thereof in a plane parallel to the flat rear face of the hook-receiving profile's rear face 56*b*. It may be possible to have the button profile defined by an integral portion of the closure member, or by a piece or assembly produced separately from the closure member and subsequently fastened to the rear side thereof.

In the modified garment, a button hole or opening is provided in the waist portion 104 of the jeans at a short distance below the upper boundary 104*a* and a short distance laterally outward from the second side 106*b* of the notch 102, and is preferably formed in a conventional manner with stitched reinforcement around the hole. The button hole cooperates with the button profile on the second leg of the closure member after the pin on the first leg has been lowered into the tubular passage. Accordingly, the button is used to secure the closure member in a closed position situating the flat face of the closure member, from which the button profile projects, in a position against or just in front of the front of the jeans at the boundaries of the notch. When the button arrangement is unfastened, the closure member is once again pivotal about the pin on the first leg 16*a* out of and back into this closed position of the closure member. The width of the V-members leg(s) may need to be increased order to position the button profile carried thereon far enough to the side of the notch 102 when the V-member is worn to engage through the button hole in the garment.

Different product lines for women may be offered in accordance with the present invention. Scenario A could include a pair of jeans having a V-shaped front female plate with an optional belt having a front V-shaped belt-closure with optional jewelry inserts. Scenario B could include a pair of jeans having V-shaped front and back female plates with an optional belt having front and back V-shape closures with optional jewelry inserts. Scenario C could include jeans having V-shaped front, back and side female plates and an optional belt with front, back and side V-shaped closures with optional jewelry inserts. Again, the jeans can be worn without the belt strap and closure, or worn with a V-shape closure/accessory and jewelry, but are designed to be able to accept one or more V-belt closures. In these exemplary scenarios, when the jeans are purchased, they come with one 1, 2 or 4 metal female V-shaped plates compressed, or riveted, in the garment. Unless the plates are appropriately equipped, no jewelry is attachable at this point. Belts which match the 1, 2, or 4 V-shape configurations can be bought separately, as can optional jewelry to attach to the V-shape closure(s) In the multiple V-closure embodiments, a multi-piece belt strap may be used in which different sizable sections of the assembled belt are each interconnected to another by closure members at opposing ends of the section. In these scenarios, once an initial pair of jeans has been obtained, then the purchaser can buy additional jewellery attachments. These scenarios are not limiting to the scope of the present invention. As an example of one further possibility, a one-piece belt strap with a single V-shaped belt closure member could be worn with the closure member over a notch positioned somewhere other than the front of the garment's waist.

While the illustrated embodiments are shown and primarily described in terms of a pair of jeans, it will be appreciated that other garments worn generally about the waist may feature a similar notch, which may or may not be positioned at this central front position. For example, other pants, skirts or shorts may be similarly configured for cooperation with a belt or accessory of the present invention and the position(s) and number of waist notches may be altered, especially for waist-worn garments that do not feature a fly.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A garment for wearing about a wearer's waist, the garment comprising:

a garment body having a front side, a rear side, a waist portion defining a waist opening at an upper boundary thereof;

an open notch depending into the waist portion of the garment body from the upper boundary of said waistband portion, the open notch having first and second sides that extend downwardly from the upper boundary of the waist portion and connect together at a bottom of the notch at a distance below said upper boundary of said waist portion;

a notch border member having greater rigidity than the garment body and comprising first and second legs and a bottom end at which said first and second legs are connected together, the first and second legs and the bottom end of the notch border member being positionable to lie respectively along the first and second sides and bottom of the notch so as to align an open space between the legs of the notch border member with the open notch in the garment;

a fly formed in the garment body and extending downwardly from the bottom of the open notch;

a fastening arrangement at the fly for selective opening and closing of said fly;

a connection formed between the first leg of the notch border member and the garment body at the first side of the notch, the notch border member being supported on the waist portion of the garment by the connection and the legs and bottom end of the notch border member being positioned externally of the garment at an externally visible location adjacent the open notch in the waist portion of the garment; and a securing mechanism installed between the second leg of the notch border member and the waistband portion of the garment body at the second side of the notch, the securing mechanism being operable between an engaged state securing the second leg to the garment body at the second side of the notch to hold the notch border member in a closed position bordering both sides of the notch and aligning the open space of the notch border member with the open notch in the garment body, and a disengaged state releasing the second leg from the garment body at the second side of the notch for swinging of said second leg over to the first side of the notch to reveal access to the fly at the bottom of said notch to enable opening of said fly.

2. The garment of claim 1 the securing mechanism comprises a magnet and magnetically attractable material carried on opposite ones of the garment body and the notch border member.

3. The garment of claim 1 wherein the connection between notch border member and the garment body comprises a channel extending along the first side of the notch and a pin that is carried on the first leg of the notch border member and is received within the channel, the notch border member being pivotal about an axis of the pin to swing the notch border member into and out of the closed position.

4. The garment of claim 3 wherein the notch border member is removable from the garment body by disengagement of the securing mechanism and withdrawal of the pin from the channel.

5. The garment of claim 1 wherein the securing mechanism comprises a button fastening arrangement between the second leg of the notch border member and the garment body at the second side of the open notch.

6. The garment of claim 1 further comprising an ornament carried on the notch border member between the first and second legs thereof.

7. The garment of claim 6 wherein the ornament is suspended from both the first and second legs of the notch border member at a distance upward from the bottom end thereof.

8. The garment of claim 7 comprising flexible supports suspending the ornament from the first and second legs of the notch border member.

9. The garment of claim 6 wherein the ornament is detachable from the notch border member for interchanging with another ornament.

10. The garment of claim 8 wherein each flexible support comprises chain equipped with a clasp for selective engagement to and disengagement from a respective one of the first and second legs of the notch border member.

11. The garment of claim 1 wherein the notch and the notch border member are V-shaped.

* * * * *